United States Patent [19]

Schnebly et al.

[11] Patent Number: 4,807,686

[45] Date of Patent: Feb. 28, 1989

[54] SHADE SYSTEM

[75] Inventors: John Schnebly, Albany; Thomas J. Marusak, Loudonville, both of N.Y.

[73] Assignee: Comfortex Corporation, Cohoes, N.Y.

[21] Appl. No.: 18,189

[22] Filed: Feb. 25, 1987

[51] Int. Cl.[4] ..... E06B 3/94

[52] U.S. Cl. ..... 160/84.1; 160/7

[58] Field of Search ..... 160/84 R, 7, 172, 310, 160/265, 331, DIG. 17, 246, 247, 248, 249, 250, 32, 33, 34, 107, 333, 334, 338, 167, 169, 188, 133, 189, 243, 244, 245, 5

[56] References Cited

U.S. PATENT DOCUMENTS

| | | | |
|---|---|---|---|
| 1,377,038 | 5/1921 | Walker | 160/248 |
| 1,490,754 | 4/1924 | Wagner | 160/248 |
| 1,887,646 | 11/1932 | Johnston | 160/243 |
| 2,755,081 | 7/1956 | Johnson et al. | 160/188 |
| 3,289,741 | 12/1966 | Gossling | 160/188 |
| 3,537,504 | 11/1970 | Deane | 160/243 |
| 4,019,554 | 4/1977 | Rasmussen | 160/84 R |
| 4,307,768 | 12/1981 | Anderson | 160/84 R |
| 4,503,900 | 3/1985 | Osaka et al. | 160/107 X |
| 4,644,990 | 2/1987 | Webb et al. | 160/5 |
| 4,647,488 | 3/1987 | Schnebly et al. | 160/84 R X |

*Primary Examiner*—Ramon S. Britts
*Assistant Examiner*—David M. Purol
*Attorney, Agent, or Firm*—Schmeiser, Morelle & Watts

[57] ABSTRACT

A motorized header element for extending and retracting an accordian-type shade along a pair of rectalinear and curvilinear mounted side tracks and for effecting an environmental seal in the plenum formed between the shade and the surface which it covers. The invention is adaptable to both automatic and manual operation and contains within its automatic/motorized drive system electrical circuitry for recharging its battery power source.

12 Claims, 4 Drawing Sheets

SHADE SYSTEM

FIELD OF THE INVENTION

This invention relates to window shade treatments in general and more particularly to window shade treatments that can be deployed to travel over vertical, horizontal, curvilinear, and inclined surfaces and allow the shading material to be oriented with folds arrayed vertically or horizontally as is desirable for greenhouses, skylights, and sliding glass doors. In addition, this invention relates to such systems which also form a nominal seal between the shade and the shaded windows.

BACKGROUND AND OBJECT OF THE INVENTION

Prior to the instant invention several techniques have been employed to provide extendable, retractable covering for planar surfaces. Analogous art was concerned with providing movable covers over openings ranging from the common window to missile silo emplacements. Covers ranged from the opaque or translucent conventional window shading to a multiplicity of interlocked slats or meta*/concrete segments. The nonmanual motivation, in turn, was just as varied; the heavier and more cumbersome shading/covering often requiring heavy, cumbersome machinery which motivated it, usually through pulley and cable mechanisms. In instances where the motivation comprised a direct drive or geared motor/traction mechanism, the motor was invariably fixed and the driving gear train either engaged portions of the cover or, as was more often the case, drove a pulley system or a capstan to either take up or play out a drive cable.

More notably the window shading art has begun to develop materials particular to the needs of those seeking insulative shading, particularly in the home or in such environment as the common greenhouse. To this end, there have been recent developments in insulative shading materials and apparatus. Patents issued to Rasmussen (U.S. Pat. No. 4,019,554) and Colson (U.S. Pat. No. 4,603,072) are indicative of such interest and portray a state-of-the-art benchmark for the instant invention. Rasmussen developed a thermal insulating curtain for use especially in greenhouses by adapting the slat array of the common Venetian Blind with parallel interconnecting foldable fabric nettings to obtain the result of a rectalinear curtain comprised of two fabric surfaces seemingly partitioned by a slat array. It is intuitive that the slat elements comprising the partitions of the curtain were rigid enough to allow the curtain to rest extended on a horizontal surface. Absent rigidity of the slats however, the Rasmussen invention could only function in a vertical suspension mode. Colson on the other hand, developed a honeycomb, insulating shade comprised of continuous thin film plastic material which effected a series of concatinated flexible tubular elements. Like The Rasmussen invention however, Colson's in order to be used on a horizontal planar surface would have to rest on the margins or frame of a window or else be used with supporting battens.

Typical of the motorized drives employed with current greenhouse and solar shade apparata is the arrangement disclosed in the patent issued to Esposito (U.S. Pat. No. 4,606,157) wherein a shade is provided for being drawn across greenhouse glazing by action of a motor driven roller connected at one end of the shade and used to play out or wind up the shade. In the Esposito arrangement, the other end of the shade is connected to a device which applies a constant retracting force that is used to maintain tautness in the shade. The shade is played out and taken up by running between a pair of parallel tracks which have inward facing grooves. The outer margins of the shade contain a filament which lends a bulbous character to the shade margins. These margins are effectively captured in the grooves of the parallel tracks.

Not withstanding the aforesaid advancements to the art, there yet remain onerous problems to effectively shading glazed surfaces and particularly vertical and horizontal windows. Some of the most bothersome involve nonmanual drive mechanisms which have heretofore embodied cord, cable and pulley drive mechanisms, do not effect good environmental seals, and, when used in any position substantially off the vertical, tend to sag.

It is therefore an object of this invention to provide a shade drive mechanism that operates without the encumbrances of pulleys, cords or cables.

It is a concomitant object of the invention to provide a system having a discrete, resident drive means for each shade unit.

It is yet another object of this invention to provide a means for disengagement of the invention's resident drive means and for stabilizing or braking shade travel.

It is yet another object of the invention to provide a form of electrical energization to the resident drive means.

It is yet another object of this invention to provide a shade which may be moved and stopped by manual manipulation of the resident drive mechanism for movement and securement at any point between the closed and open positions.

Other objects are set forth hereinafter or shall become apparent from practice with the invention or similar embodiments the same being practiced within the bounds of the appended claims.

SUMMARY OF THE INVENTION

A pair of parallel extruded tracks comprising, in cross section, route, cusp and tongued subsections are placed with tongues facing each other in parallel disposition and in registry with a window's parallel frame members. The tracks, in parallel disposition, may be readily bent to follow the rectalinear and curvilinear frame work of a greenhouse or a skylight. A honeycomb shade fabric is employed having notches or a series of notches comprising a groove located colinear in the margins of the shade. It is the function of the notches or groove to accept therein the tongue portions of the parallel tracks. Such a facility allows this shade to be expanded and retracted while maintaining the tongues of the track members in slidably yet captive relationship. The honeycomb structure of the shade in combination with the aforesaid tongue-in-groove (captive) feature, provides a high degree of structural integrity that results in a non-sagging shade apparatus.

The shade is disposed on its track network. In the preferred embodiment one end is captivated or fixed to a window sill or mantle. The other end of the shade is affixed to a rigid housing member known as the header. However, it is also possible to affix each end of the shade to a header. Mounted inside the header(s) is a DC motor, DC power supply means comprising rechargable nickle-cadmium batteries, a photovoltaic element with associated circuitry, mechanical means for disengaging,/engaging the motor apparatus and braking travel of the header, a gear train which ultimately terminates on each end of the header in a drive wheel, and end caps having means for conformably engaging the tongues of the tracks and for providing drive wheel and idler wheel mounts so that the wheels, in projecting beyond the ends of the header may engage the cusp portions of the tracks and thus provide the coupling of header motive power through the gear train to the tracks, whereby the header may translate along the tracks, extending and retracting the honeycomb shade. The tongue-in-groove arrangement common to both shade and header assures an environmental seal when the shade is fully extended; that is, in the case of shading a glazed surface, a plenum is formed between the glazed surface and the extended shade that is effectively closed yet not airtight. The shade will allow obscuration of solar energy while expanding air within the plenum so formed may still escape through the non-hermetic seal. In other applications, this non-hermetic seal allows the transfusion of air or other vapors.

By locating the motor, driven system, and manual brake handle in the header, one header may be used in a variety of modes including operations which are manual, motorized, or motorized with a manual over ride. In the manual operation the handle will engage and disengage the shaft in order to secure and locate the shade, whereas in the motorized version the drive system itself holds the shade in the desired locations. When motorizing with a manual override pressure on the header in the direction of the drive wheels will disengage the driven wheels and allow the header to be moved to any desired location without energizing the motor.

Power for the motor is provided by at least one nickle-cadmium, rechargable battery mounted within the header. The preferred embodiment utilizes a circuit board to which the battery, motor and associated switching circuitry are mounted. Also located in the header is a photovoltaic power source which is disposed to face available light. In normal operation, the shade is extended and retracted only once or twice a day and, under most circumstances, the photovoltaic power source will provide enough energy to fully recharge the battery source.

It should be understood that the preceding general description as well as the following detailed description are meant to be exemplary and instructive of the invention. The preferred embodiment should not be read as a necessary restriction on the application of the concepts herein described. Thus, while the preferred embodiment extolls the virtues of the automatic/motorized header, it should be remembered that a less costly embodiment may be achieved wherein the principle advantages of this environmental shade may be inculcated in a manually operated system.

DETAILED DESCRIPTION OF THE PREFERRED EMBODIMENT

The invention comprises a honeycomb fabric or pleated fabric which is deployed on a set of parallel tracks with a moveable header that houses a driven system. The drive system is comprised of drive wheels that engage the tracks, drive shafts that transfer power from one drive wheel to the corresponding wheel on the other end of the header, a handle that brakes the drive shaft when the shade is in the manual mode of operation or in motorized operation a motor, power supply, power transfer gearing, remote control sensors, control circuitry, and a photovoltaic energy conversion system to keep the power supply energized. The header with its drive systems is driven or moved along the parallel tracks by engagement of a toothed drive wheel to gear teeth formed into the extruded track member. The track member is comprised of a high temperature polymeric material or alternatively from aluminum or similar materials.

In the alternate embodiment the invention comprises a manual shade also having the contact sealing system of the motorized version.

Figure 1:
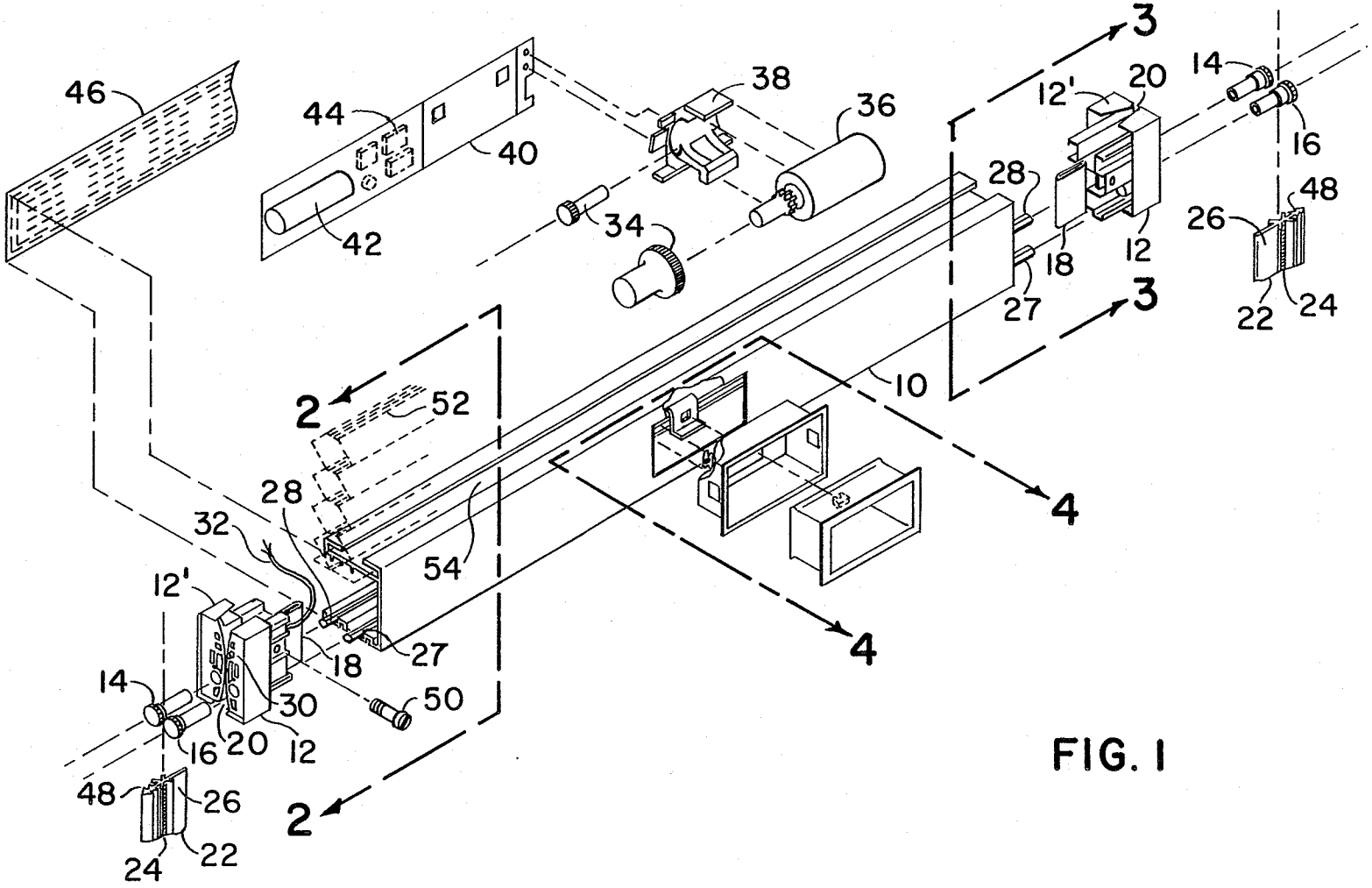
FIG. 1 is an isometric exploded view of the invention.

Referring more particularly in FIG. 1 the entire shade system is depicted in an isometric, exploded view. The major element comprises the header 10 which is formed by extruding a box-like sill from a strong rigid material such as aluminum or high temperature polymeric material. Two vertically slotted end caps 12 close off the ends of the sill 10. As is shown, the end caps are ostensibly identical, in that both have wheels which project outwardly therefrom and comprise a pair of tandem wheels, the interior toothed drive wheel 14 held by the end cap in close registry to the rear exterior toothed idler wheel 16.

The toothed idler wheels 16 are connected to each other by means of a hexshaft 27, as shown in FIG. 1. The interior wheels 16 are not geared to the motor and therefore turn freely. The drive wheels 14 are geared to the motor, when motorization is used, and are connected to the motor and each other by means of drive shaft 28. Should a drive wheel 14 encounter a obstruction in the toothed cusp 24 the movement of drive wheel 14 onto the obstruction will pull the idler wheel 16 into closer registry with cusp 24 thus assuring that motion proceeds with at least two of the four drive wheels maintaining registration with the gear track 24 so that the header continues to travel in a manner perpendicular to the tracks.

Each end cap is symmetrical about the plane passing vertically down through the end caps and the header. Each end cap comprises two halves 12, 12' which are held in close registry by bracket 18. The contained registry of the end cap halves gives rise, in conjunction with spring bracket 18, to end cap gaps 20. In the preferred embodiment, the header rides along tracks side tracks 22 with wheels 14, 16 providing traction drive while seated in the toothed cusp 24 of side tracks 22. The tongue 26 of track 22 resides in the gap 20 formed by the predisposition of end caps 12, 12' and bracket 18. Powered take off is from hexshaft 28 which impart shaft rotary motion to the drive wheel 14. A limit switch 30 is also located in the left (or right) end cap and communicates circuit wise with a circuit board, also enclosed in the header. In one embodiment a magnet may be placed at any desired location along the window frame in order to activate switch 30 and stop shade travel.

The hexshaft 28 is coupled by pinion and planetary gears 34 to the motor 36. A suitable framework 38 is used to position and retain the motor on the circuit board 40. In addition to the motor, circuit board 40 also contains battery power source 42, switching and battery charging circuitry 44 and is positioned in the header 10 as depicted in FIG. 1 so as to allow motor gear train engagement with hexshaft 28. On the inner side of the header (or facing a light source) is the array of photovoltaic cells 46. These cells transmute light energy to electrical energy which is thence transmitted to the switching and charging network 44 of circuit board 40 to provide charging energy for battery 42.

To set the system in its operational configuration, edge or side tracks 22 are installed parallel and in registry with a window frame. The side tracks may be installed by inserting route 24 into a groove or dado which is cut into parallel, opposing sides of the window. The side tracks are inserted deep enough to retain them in the frame while allowing ample room for cusps 24 to be straddled by drive wheels 14, 16. The top of honeycomb shade 52 is affixed to one end of the frame or mantle of the window to be covered, with its other end inserted in header 10 by sliding its base into groove 54 of the header element. If preferred, both ends of the shade 52 could be inserted into a traveling header. End caps 12 are then inserted so as to engage and envelop track tongues 26 while engaging cusp 24 with wheels 14, 16 which are biased against cusp 24. Once tongues 26 are properly enveloped within the groove 20 of header end caps 12, drawbolt 50 is turned to limit the movement of end cap halves 12, 12' which are biased against each other by the tension of spring bracket 18 so as to effect the slideable, environmental seal of the invention. Additional details of FIG. 1, namely the handle well positioning for manual operation are discussed in greater detail hereinafter.

When the shade is installed in its vertical mode, as is the case when covering sliding glass doors, the tracks are installed at the bottom and top of the glass frame. However, in this configuration it has been found preferable to remove the tongue 26 from the lower track and increase the width of the honeycomb shade slot 62 so that the slot may envelop the cusp 24 of the bottom, tongueless, track.

Figure 2:
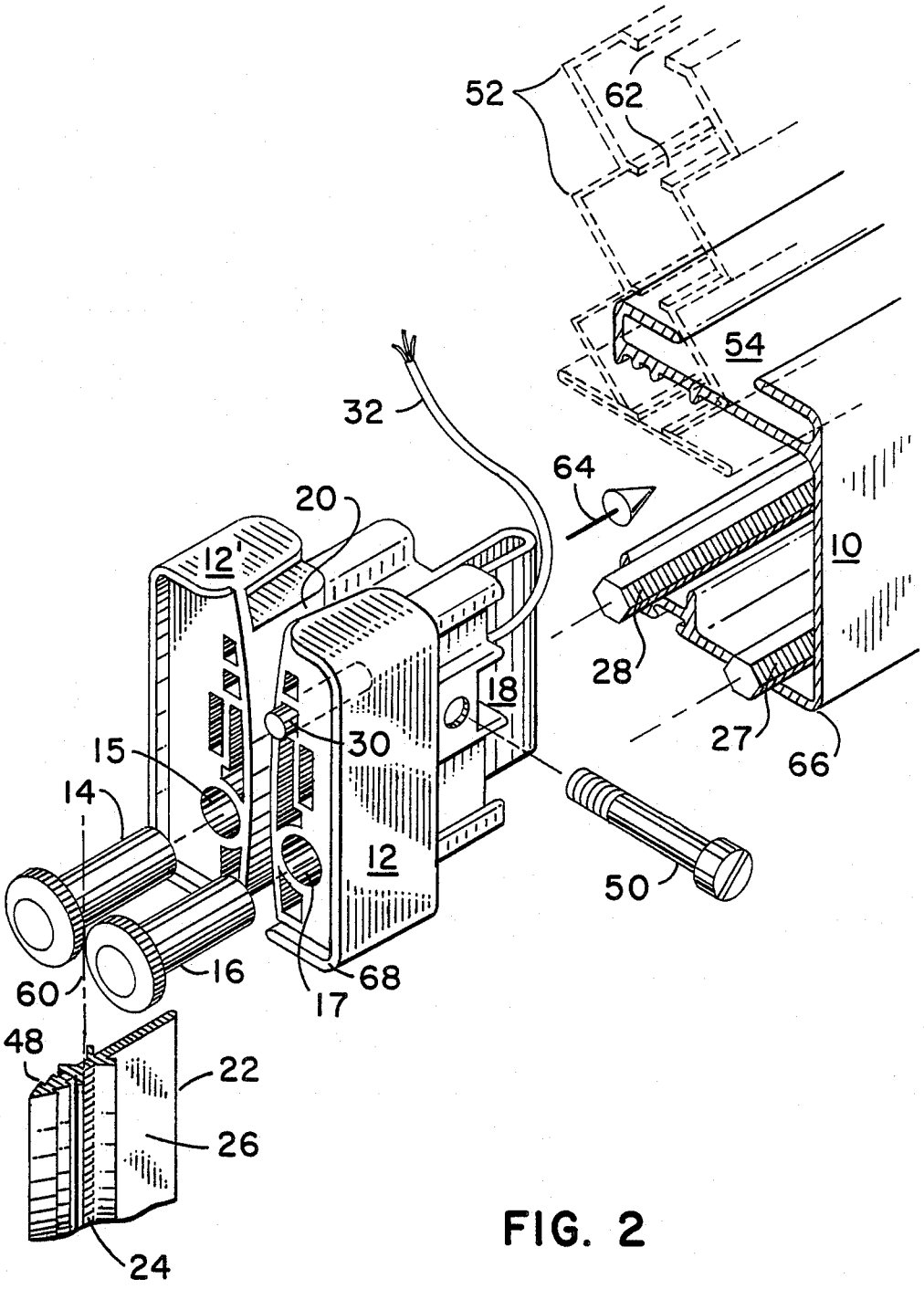
FIG. 2 is an isometric exploded view of the left side of the header.

With reference being made more particularly now to FIG. 2, the readers attention is drawn to the detail relating side track 22 composition. Route area 48 may be readily inserted in the groove or dado of the window frame. In lieu thereof, those versed in the art will readily recognize that the route area may also comprise an "L" shaped flange which may be affixed to the window frame by other suitable means such as butt-end adjoining using screws or similar fasteners or, could in the alternative be simply nailed to a frame having a weather strip or suitable insulation/sealing means inserted therebetween. Drive wheels 14, 16 are inserted in their respective apertures 15, 17 to engage the hexshafts 27, 28. When properly installed, the drive wheels appear almost flush mounted with the end cap ends, only the traction portion being exposed beyond the face of the end caps. Thus, engagement with cusps 24 along center line 60 will allow tongue 26 to remain deeply inserted in end cap groove 20, effecting the aforementioned environmental seal, while allowing the drive wheels 14, 16 to move outwardly on shafts 27, 28 in the event that tracks 22 are not always set equidistant from one and other due to variations in installation or measurements.

As the shade is extended or retracted by movement of the header 10, the cells or folds of the shade material continues to surround the tongue 26 which supports each cell or fold of the shade and prevents sagging of the shade material. The wheels 14, 16 extend beyond the tongue 26 and engage the toothed cusp 24. Thus, the tongue 26 seals the shade to the window frame and substantially prevents air and other vapors from moving into or out of the plenum created by the shade when deployed over the window. However, the tongue 26 does not completely seal the shade to the window. In the event that the temperature in the plenum rises due to the influence of sunlight, the heated air is driven around the seal due to the temperature difference and the resulting changes in air pressures. In order to move substantial air and other vapors around the seal, a temperature difference of greater than 50° F. is required. At night during periods of cold weather, the temperature difference between the outside of the shade and the plenum is typically 30° F. or less; however, during periods of sunlight the temperature between the plenum and the outside of the shade can vary from 60° to 80° F. Therefore, the tongue of the track not only supports the shade and locates it in the desired plane, but also seals it against unwanted air migration while allowing air to pass when desired during daylight hours.

Another important aspect of the invention which is disclosed in detail, in FIG. 2, is the honeycomb shade slots 62 which are located at the ends of each discrete shade partition member. It is these grooves which cooperate with side track tongues 26 to carry out the full environmental sealing of the invention. Finally, complete insertion of end cap 12 into header 10, as depicted by arrow 64, so that header flange 66 achieves a flush mounting with end cap flange 68, completes assembly of the preferred embodiment.

Figure 3:
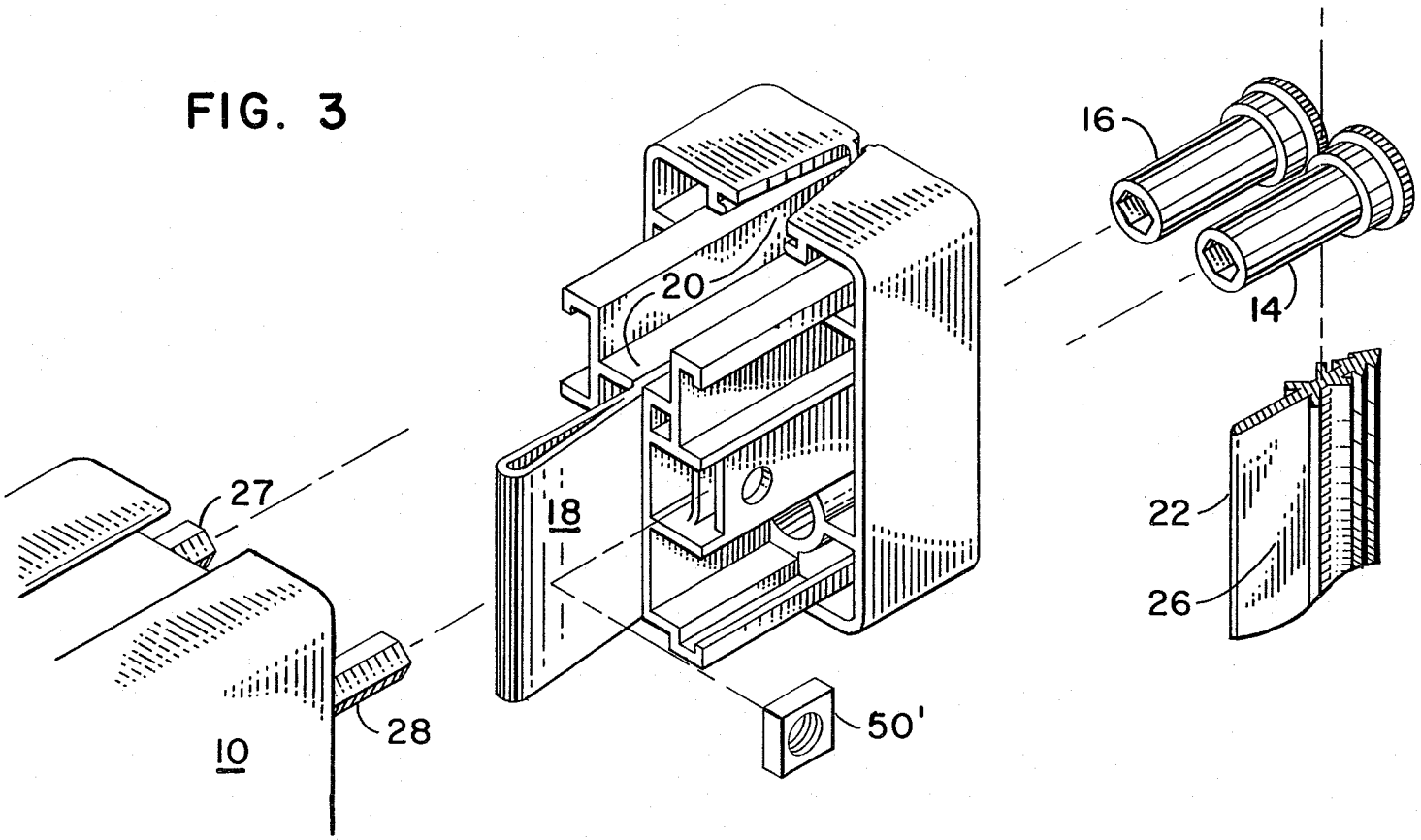
FIG. 3 is an isometric exploded view of the right hand side of the invention with a detail of the side track.

FIG. 3 also an isometric exploded view of the right hand end cap clearly illustrates the symmetry between the end caps. More clearly depicted in this view is groove 20 of the end cap which cooperates with tongue 26 of side track 22. The female receptacle for draw bolt 50 is shown here as an insertable square nut 50'. Hexshafts 28 and 27 are insertable in the direction shown so as to engage the drive wheels 14 and 16 respectively.

In the motorized/automatic embodiment, manual operation may be accompanied by simply pressing the header toward the window. This pressure will overcome the biasing of spring bracket 18 and disengage the drive wheel 14 from cusp 24 allowing the shade to be moved manually.

Figure 4:
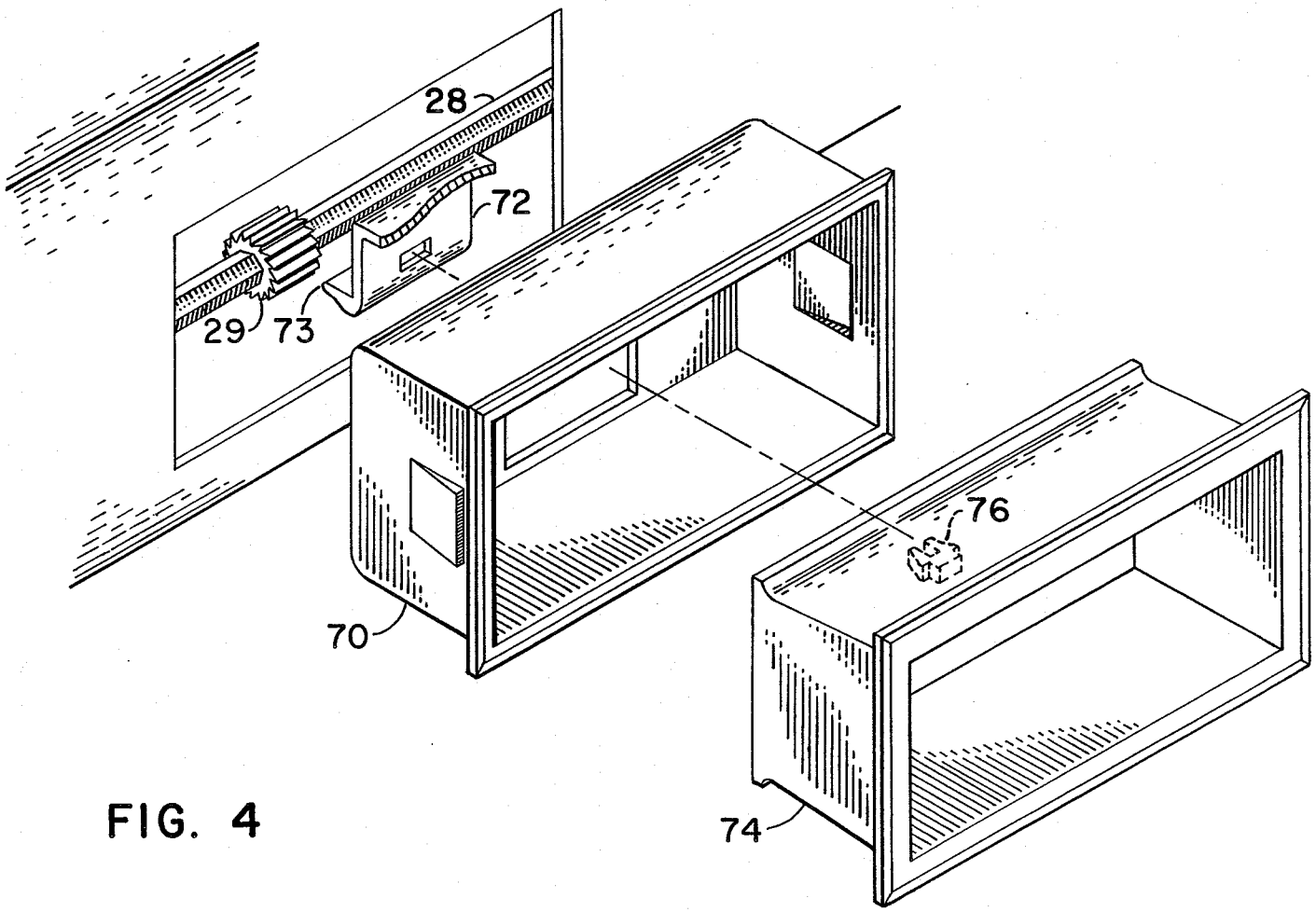
FIG. 4 is a detail of the handle well for manual operation.

In the alternative, manual operation, shown in FIG. 4, the position of brake 72 is arranged so that when handle 74 is toggled upward or downward in its well 70 containment, the pawl 73 of the brake 72 will disengage from the gear 29 located below the brake 72 which in turn disengages hexshaft 28, thus allowing the header to be translated manually. When desired positioning of the header (and consequently shade) is attained, handle 74 is allowed to return to its rest position and pawl 73 of brake 72 will engage gear 29 on hexshaft 28. This positive engagement will lock the hexshaft and its follower drive wheels 14 in a stationary position. Mounted in a toggle position at the rear of the well is hexshaft brake 72 which, in this mode mounts unobtrusively through well 70 for removable attachment to the well-insertable handle 74 by trapezoidal mounting clip 76 which is centrally affixed to the backside of the handle. As may be readily inferred from the foregoing description, during motorized/automatic operation, hexshaft 28 engages the drive gear network 34 (see FIG. 1) off of motor 36. In the later description, manual operation, hexshaft 28 has no motor gears but only gear 29 located under the brake 72 an drive wheels 14, located in the end caps 20, hexshaft 28 being a straightthrough shaft connecting the drive wheels 14.

What is claimed is:

1. A window shade deployment system comprising:

a pair of tracks adapted to be located opposite each other and attached to the sides of a window opening;

a window shade of the pleated type, one end of said shade affixed to a portion of the window frame, each side of said shade having therein a slot engaging with one of said tracks as said shade is moved over said opening;

a header secured to the opposite end of the shade and mounted transverse the sides of said frame, said header having a motor and electrical circuitry mounted therein, said motor providing motive power to traction drive wheels for the purpose of propelling said header over said pair of tracks;

at least two pairs of traction drive wheels rotatably secured to the header, one pair engaging each of said tracks, each wheel pair having an interior wheel adapted to travel on one side of the track and an opposing, closely biased exterior wheel adapted to travel on the other side of the track, at least one wheel in a wheeled pair mechanically coupled to one wheel in the other wheel pair and connected therewith, to said motor, whereby movement of said wheel pairs along said tracks is virtually identical with regard to speed and direction and said shade is played out and taken up by said header motion, unfolding and folding, as said motor drives said traction wheels and propels said header along said tracks.

2. The invention of claim 1 wherein the interior wheels of each wheel pair and the exterior wheels of each wheel pair are held in registry with and biased to each other by end caps situate on each end of said header, said end caps comprising two halves that are registrably connected by bracket means so that an interior wheel is disposed in circumferential registry to its exterior counterpart.

3. The invention of claim 2 wherein at least one side of each track is toothed and the particular wheel adapted to travel on said track is also toothed and further, each wheel adapted to travel is directly motivated by said motor.

4. The invention of claim 1 wherein said tracks comprise an elongate essentially flat strip having along a first lateral edge thereof fixing means for inserting said first lateral edge into the side of a window frame and compelling the second lateral edge to project from said frame, and further comprising between said lateral edges, traction wheel engaging means on at least one side of said strip.

5. The invention of claim 4 further comprising a cusp bordering said wheel engaging means.

6. The invention of claim 5 further comprising a cusp border as the sole second lateral edge.

7. A motorized window shade system comprising:

a pair of window edge tracks in parallel registry, each of said pair having on at least one side traction wheel engaging means;

a header element comprising a housing of length sufficient to span said window edge tracks and containing therein a traveling motor, said motor geared to traction wheels to propel the header element along said edge tracks to extend and retract said shade, said header further comprising end caps, one on each end of the header, each end cap vertically divided and each half thereof biased to the other defining between said halves a slot for slidably receiving a portion of a window edge track and further comprising on each end cap a pair of wheels, each wheel rotatably disposed in one of said halves, at least one of said wheels geared to said motor, said wheel motivated by said motor to provide traction and thereby translation of said header along the edge tracks; and a honey-comb, accordion-type shade capable of extension and retraction over the area defined by said window, one end of said shade attached to the header and extended and retracted by the header as it is motivated over the window, said shade further comprising slotted shade ends which engage portions of said window edge tracks in slidable registry to form a nonhermetic seal.

8. The invention of claim 7 wherein said header element further comprises a motor energization means.

9. The invention of claim 8 wherein the motor energization means is a rechargable battery and further comprises a photovoltaic recharging means colocated on said header and adapted for orientation toward a light source.

10. The invention of claim 7 wherein the motor energization means further comprises at least one electrically energized edge track.

11. A dual capability window shade system having both automatic and manual operation comprising:

a pair of window edge tracks;

an elongate header element containing therein a traveling motor and motor gearing, drive wheels attached to both ends of said header element for engagement with said window edge tracks, said wheels comprising wheels pairs, said pairs in tandem orientation and biased one to the other to engage therebetween said window edge tracks and further comprising drive wheels that are releasably engaged to said motor, and further comprising means for manually releasing said drive wheels from motor gearing; and a shade of honey-comb, accordion-like construction capable of extension and retraction over the area defined by the window utilizing said shade system, one end of said shade attached to the header and its opposite end attached to the frame of said window, whereby said shade is extended or retracted by the motion of the header as it moves over said tracks under motivation of said traveling motor and, in the alternative drive mode, is moved over said tracks by manual persuasion after said drive wheels are manually disengaged from said motor by actuation of said means for manually releasing said drive wheels.

12. An improved method for the motorized retraction and extension of an accordion-type window shade comprising the following steps:

engaging a pair of window edge double-faced tracks with tandem straddling drive wheels, said drive wheels provided to at least one header element;

securing at least one end of an extensible and retractable according-type window shade to the header element; forming a seal between each of the tracks and shade with a projecting side track and an accordion-type shade comprised of a plurality of shade slats, said slats slotted at each end thereof and adapted to receive said track projection therein; and selectively energizing a traveling motor that is mounted on the header element to tractor the header by said drive wheels along the edge tracks in the predetermined direction.

* * * * *